US007353763B2

(12) United States Patent
Verbickis et al.

(10) Patent No.: US 7,353,763 B2
(45) Date of Patent: Apr. 8, 2008

(54) SHIP

(76) Inventors: Leonidas Verbickis, Emmershäuser Mühle, 1 Weilrod, Hessen (DE) 61276; Vladimir Petrov, Str. Savanory 64-12, Vilnius (LT) 2009

( * ) Notice: Subject to any disclaimer, the term of this patent is extended or adjusted under 35 U.S.C. 154(b) by 256 days.

(21) Appl. No.: 10/260,687

(22) Filed: Feb. 13, 2002

(65) Prior Publication Data

US 2004/0103462 A1 May 27, 2004

(30) Foreign Application Priority Data

Nov. 22, 2001 (DE) ..... 101 57 277

(51) Int. Cl.
*B63B 1/04* (2006.01)

(52) U.S. Cl. ..... 114/56.1; 114/61.32; 114/61.33; 114/140

(58) Field of Classification Search ..... 114/56.1, 114/61.32, 61.33, 63, 127, 140; D12/300, D12/303
See application file for complete search history.

(56) References Cited

U.S. PATENT DOCUMENTS 313,664 A * 3/1885 Gerrard ..... 114/140
2,418,636 A * 4/1947 Harasty ..... 114/358
2,914,014 A * 11/1959 Carl et al. ..... 114/281
2,980,049 A * 4/1961 Ward et al. ..... 114/140
4,040,373 A * 8/1977 Jones, Jr. ..... 114/126
4,217,845 A * 8/1980 Hood et al. ..... 114/125
4,360,350 A * 11/1982 Grover ..... 44/88 R
5,263,433 A 11/1993 Meyer ..... 114/282
6,000,357 A 12/1999 Allison ..... 114/271
6,019,056 A 2/2000 Tochigi etal. ..... 114/271
6,062,159 A 5/2000 Cao ..... 114/271
6,116,180 A 9/2000 Thompson et al. ..... 114/271
6,176,196 B1 1/2001 Holter ..... 114/271
6,257,620 B1 * 7/2001 Kenney ..... 280/810

FOREIGN PATENT DOCUMENTS

DE 2462047 A1 5/1976
DE 19738215 A1 11/1999

* cited by examiner

*Primary Examiner*—Sherman Basinger

(57) ABSTRACT

A ship includes semi-bottoms that transition into the ship's sides, and a keel that extends downwardly from the semi-bottoms. The keel and semi-bottoms form an equivalent of 120 degree therebetween. Each of the sides is located in the same planar surface with the appropriate semi-bottom, and the height of the keel is equal to or less than the breadth of the semi-bottoms.

8 Claims, 2 Drawing Sheets

SHIP

BACKGROUND AND SUMMARY OF INVENTION

The present invention relates to the field of shipbuilding, and more particularly, to the form of a ship which may be used in all types of ships. The reconstruction of available ships in accordance with the form of the invention is also possible without tangible capital investments.

A ship generally includes a floatable hull having boards with left and right exterior sides, and a bottom with left and right exterior semi-bottoms. The semi-bottoms transition into the sides at the upper portions thereof, and meet at their lower edges along the longitudinal center of the ship. A keel extends downwardly from the bottom of the hull and generally along the length thereof. When navigating in aqueous medium, the underwater part of the ship includes the semi-bottoms and keel, and the above-water part includes the boards.

The present invention concerns improvement of major nautical features and navigability qualities of a ship, namely: buoyancy, stability, and propulsive quality, without the need for auxiliary devices. The invention achieves improvement of such nautical features and navigability qualities by significant modification of the form of the ship as compared with conventional ships. This improvement is implemented by unique specification of the angle between the semi-bottoms, the height to breadth relationship of the keel and semi-bottoms, and the relationship between the semi-bottoms and the boards.

Buoyancy. The waterline of a ship, where the surface of the water meets the hull, affects the buoyancy and weight-carrying capacity of the ship. The waterline area of a ship having an acute form of an underwater part is not large. Therefore the buoyancy and weight-carrying capacity of such a ship is comparatively small. In general, as the angle formed by the semi-bottoms increases, the area along the waterline increases and, consequently, the buoyancy and weight-carrying capacity of the ship increase. By continuing to increase this angle, it would seem that the buoyancy and weight-carrying capacity of the ship should also continue to increase. However, it has been found that upon increasing the angle between the semi-bottoms past a certain angle, the ship fails to meet technical safety requirements. Thus, it has been found that there is an optimal value for the angle between the semi-bottoms at which the maximum practical buoyancy and appropriate weight-carrying capacity are achieved without deteriorating the safety and navigability qualities of a ship.

Stability. If a heeling moment arises, the underwater part of a ship, which includes the semi-bottoms and keel, initiates a dynamic performance opposite the heeling moment, which counteracts the negative tipping effect of the heeling moment and causes the ship to level. It has been found that there is improvement of this leveling action by increasing the height of the keel as compared with its height on a conventional ship, while maintaining the height of the keel comparable with breadth of the semi-bottoms.

Propulsive quality. In the course of moving, a ship must overcome the resistance of the aqueous medium in which it is navigating. This resistance is the sum of two components:

a) Friction resistance of the underwater part of the ship against the water; and b) Wave resistance.

Components influencing the friction resistance of the underwater part of a ship against the aqueous media include the value (area) of a friction surface presented by the ship as it travels through the aqueous medium. Special devices taught in the art, and intended to increase a ship's stability, are typically located on the boards of a ship and generally increase the friction resistance of the underwater part of the ship. Absence of such special devices enables avoidance of the corresponding increase in resistance to the ship's movement through the aqueous medium.

Wave resistance is related to the waves that develop from a ship moving through the aqueous medium. An increase in waves generated by the moving ship increases the wave resistance which the ship must overcome to move forward. The form of the underwater part of a ship in accordance with the invention decreases the volume displacement coefficient of the ship. As a result, the efficiency of waves developed in the course of movement of the ship is reduced, wave resistance to the ship's movement decreases, and, consequently, the propulsive quality of the ship increases. The present invention reduces the overall resistance to movement through water by achieving stability with out the need for auxiliary devices, thereby eliminating the additional frictional drag of such devices on prior ships, and reducing the wave drag on the ship, thus increasing the ships propulsive qualities as compared with conventional ships.

The present invention improves the structure of the ship's hull and regulates the angle between the semi-bottoms, the location of the semi-bottoms and keel in regard of each other, the keel height—semi-bottoms breadth ratio, and the direction of the exterior surfaces of the semi-bottoms and boards of the ship in regard to each other. In this manner, the invention addresses the above-described deficiencies of prior ships to achieve improvement in a ship's stability, buoyancy and propulsive quality.

Other objects, features, and advantages of the present invention shall become apparent in view of the description hereof when considered in connection with accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 2:
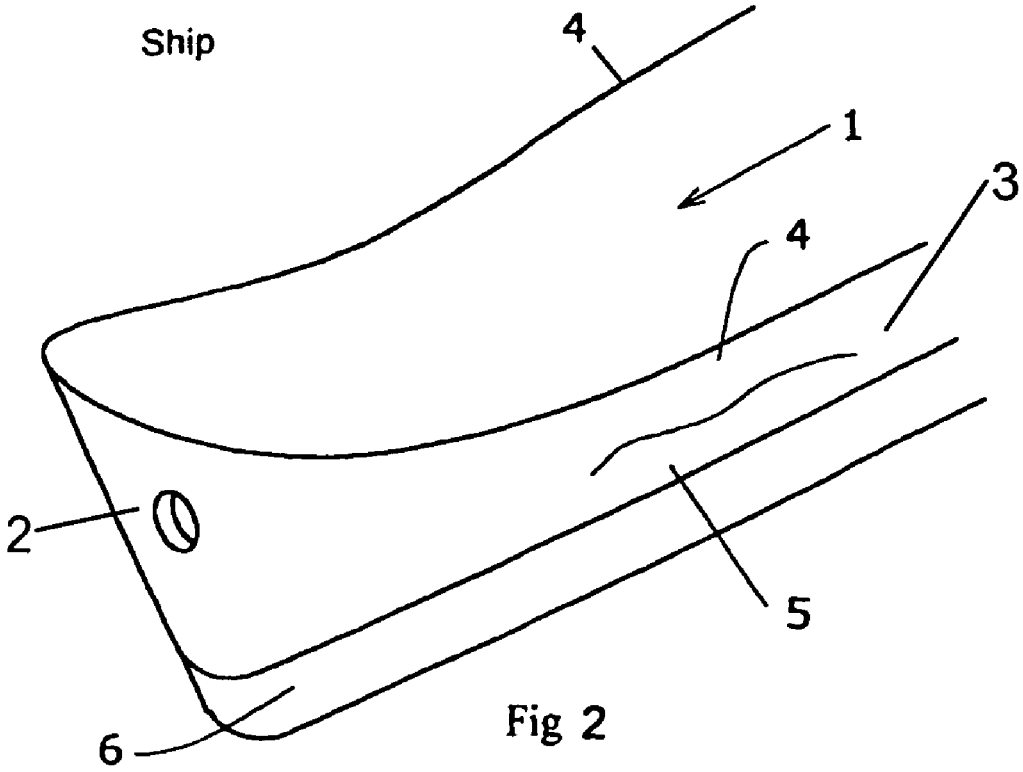
FIG. 2 is a front view of a ship according to the invention.
Figure 1:
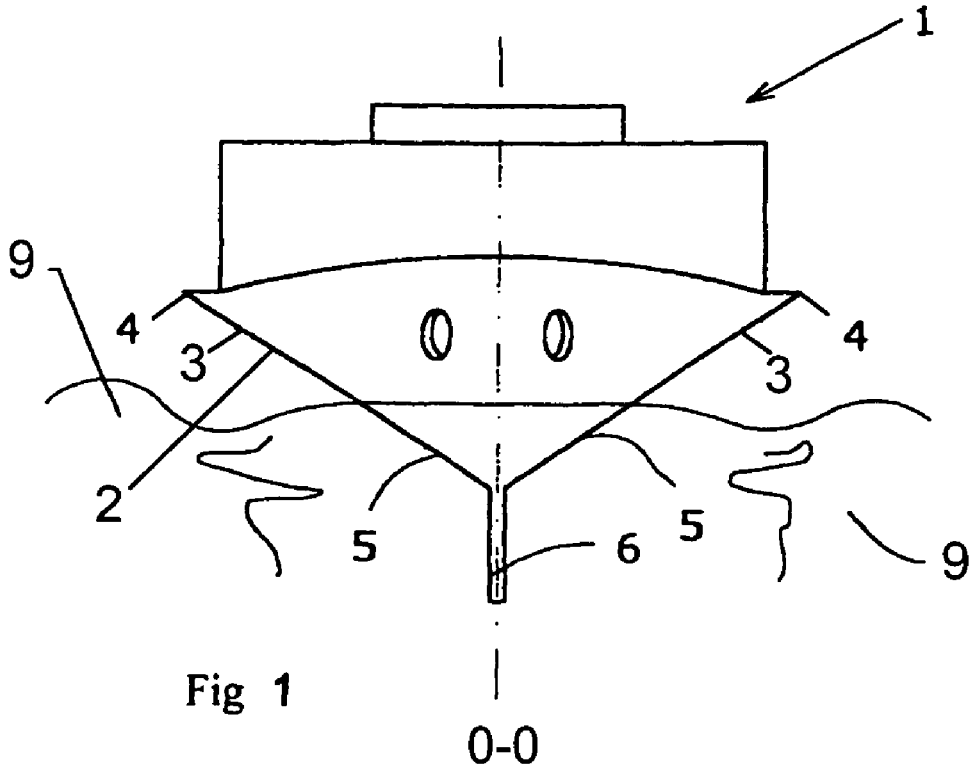
FIG. 1 is a fragmentary perspective view of a ship according to the invention.

For purposes of illustration, the present invention is shown in the drawings in connection with ship 1 (FIGS. 1-2). The ship 1 includes a floatable hull 2 having boards 3 with two exterior sides 4, and a bottom with two exterior semi-bottoms 5. The semi-bottoms 5 transition into the sides 4 at the upper portions of the semi-bottoms 5, and meet at their lower edges along the longitudinal axis 0-0 of the ship 1. A keel 6 extends generally along the length of the hull 2, and downwardly from the bottom of the hull 2 at the longitudinal axis 0-0.

In accordance with a preferred embodiment of the invention, the semi-bottoms 5 are generally planar members with essentially planar outer surfaces that cooperatively define a generally V-shaped relationship (FIGS. 3-4), with the lower edges of the semi-bottoms 5 defining the base of the V-shape. The keel 6 and semi-bottoms 5 form between each other angles $\alpha$, and together, define a Y-shape, wherein the keel 6 extends downwardly from the base of the V-shape established by the semi-bottoms 5. The exterior sides 4 are generally planar hull members with essentially planar outer surfaces that extend upwardly from the semi-bottoms 5 in the same planes to cooperatively form, in cross-section, said V-shape. Thus, a style line, defined by an offset in the plane of each exterior side 4 establishes a plane that is essentially flat.

As pointed out further below, the height "h" of the keel 6 (as measured downwardly from the bottom of the hull 2) is equal to or less than the breadth "b" of the semi-bottoms 5 (as measured from the intersection of the semi-bottoms 5 to the waterline) to establish the relative relationship of $h \leqq b$ therebetween. Thus, a chine line, defined by the intersection of each exterior side 4 of the hull 2 with the associated semi-bottom 5, is defined at a distance relative to the keel 6 wherein such distance is greater than or equal to the height of the keel 6. Additionally, the angle $\alpha$ (FIG. 4) between the semi-bottoms 5 (the deadrise of the ship), and between each semi-bottom 5 and the keel 6, is equal to 120 degrees.

Figure 3:
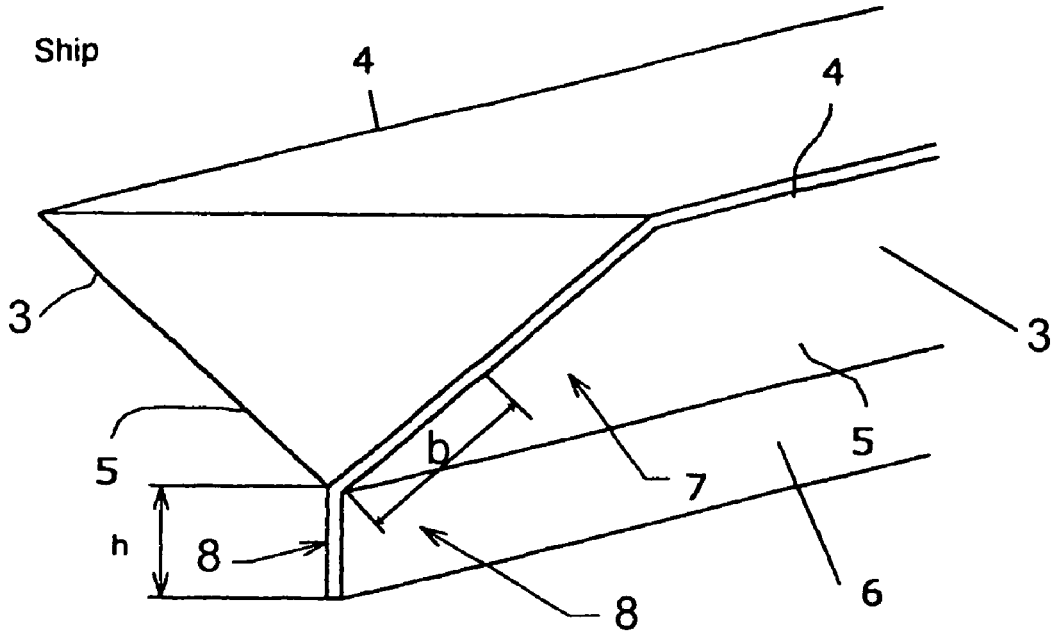
FIG. 3 is a diagrammatic fragmentary perspective view of semi-bottoms equipped with a keel and transitioning into exterior sides of boards of a ship according to the invention.
Figure 4:
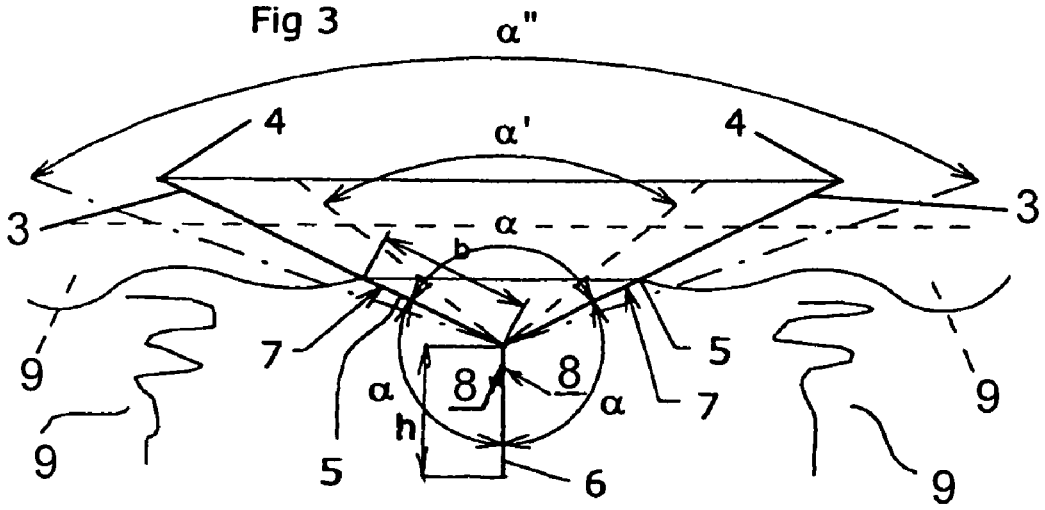
FIG. 4 is a diagrammatic front view of semi-bottoms equipped with a keel and transitioning into exterior sides of boards of a ship according to the invention.

As shown in FIGS. 3-4, the keel 6 and semi-bottoms 5 are provided with operational surfaces 7 and 8, respectively, which are in contact with the aqueous media 9.

The semi-bottoms of conventional ships which have an acute form of their underwater part forming an angle $\alpha'$ (a dotted line in FIG. 4) have a waterline area that is not large, and therefore have low buoyancy and comparatively small weight-carrying capacity. As the angle formed by the semi-bottoms increases, the area along the waterline also increases, and therefore the buoyancy and weight-carrying capacity of the ship increases. As the angle increases to an angle $\alpha''$ (a dashed-dotted line in FIG. 4), the area along the waterline continues to increase, and it would seem that the weight-carrying capacity should also increase. However, with the semi-bottoms of the ship at such a large angle, the stability of the ship is detrimentally affected, and the ship may fail to meet technical safety requirements.

It has been found that an angle $\alpha$ equal to 120° between the semi-bottoms of a ship turns out to be optimal. Thus, in accordance with the invention, the semi-bottoms 5 and sides 4 are provided as generally planar members with essentially planar outer surfaces, the keel 6 and semi-bottoms 5 form equivalent 120° angles between each other, and each semi-bottom 5 lies in the same external plane with an associated side 4 (i.e., the outer surface of each semi-bottom 5 lies in the same planar surface as the outer surface of the associated exterior side 4) (FIGS. 3-4). In this event, with a given length and breadth due to an increase in the area along the waterline, (considering the level of aqueous media 9 shown by a dashed-dotted line in FIG. 3) it is possible to reach maximum buoyancy and associated weight-carrying capacity without deteriorating the safety of the ship 1.

Consequently, when a ship 1 in accordance with the invention is additionally loaded, a larger part of the breadth of sides 4 is automatically added to the breadth "b" of semi-bottoms 5. This can be seen in FIG. 4, the dotting waterline, which coincides with a new level of aqueous medium 9, when the ship 1 is additionally loaded. By virtue of the semi-bottoms 5 and sides 4 being established in the same plane, the waterline can safely climb up the hull 2 to the point where essentially all of what was previously the side 4 (prior to the additional loading) is now washed by water 9 and added to the breadth of the semi-bottoms 5, potentially to the sheer line of the ship 1 proximate the deck thereof, and thereby substantially increasing the buoyancy of the ship 1 and enhancing its weight-carrying capacity without detrimental effect to its stability in the aqueous medium 9.

As a heeling moment arises, the underwater part of the ship 1, including the keel 6 and semi-bottoms 5 established at 120 degrees relative to one another, and the semi-bottoms transitioning into the sides 4 of the boards 6 in the same planes thereof as described above, is affected by the aqueous media 9, and initiates a dynamic performance in the form of a rehabilitation moment opposite to the performance of the heeling moment. As a result, the underwater part of the ship 1 provides a leveling action to counteract the heeling moment. To a considerable extent this is due to proportion of the height "h" of the keel 6 and the breadth "b" of semi-bottoms 5 ($h \leqq b$), which means that the dimension of the height "h" of the keel 6 and the dimension of the breadth "b" of semi-bottoms 5 are comparable (FIGS. 3-4). This enables an increase in the stability of a ship as compared with conventional ships.

Furthermore, the ship 1 in accordance with the invention, reduces the resistance of moving through aqueous media 9. This resistance is the sum of two components:

a) Friction resistance of the underwater part of the ship 1 against aqueous media 9; and b) Wave resistance.

Components influencing the friction resistance of the underwater part (surfaces 7 and 8) of the ship 1 against aqueous media 9 include the value (area) of a friction surface. Absence of special appliances on the boards 3 of the ship 1 enable it to avoid a corresponding increase in resistance to movement through the aqueous media 9. Provision of the height "h" of the keel 6 comparable with the breadth "b" of the semi-bottoms 5, and the semi-bottoms 5 at 120 degree, the water displacement efficiency ratio (the ratio of the ship's underwater part volume and the volume of the parallelepiped with the sides, which is equal to the length, breadth and sea gauge) decreases. Since the suggested form of the underwater part of the ship 1 decreases the volume displacement coefficient of the ship 1, the efficiency of waves arisen in the course of movement of the ship 1 is reduced, wave resistance to the ship's movement decreases, and, consequently, the propulsive quality of the ship 1 increases.

Thus, construction of the ship 1 in accordance with the invention, (with semi-bottoms 5 equipped with a keel 6 and transitioning into the sides 4 of the boards 3) wherein the keel 6 and semi-bottoms 5 form equivalent angles between themselves (120°), each semi-bottom 5 lies in the same plane as the associated exterior side 4 of the boards 3, and the height of the keel 6 is equal or less than the breadth of the semi-bottoms 5, enables improvement of the major navigability properties of the ship, namely, an increase of the buoyancy and weight-carrying capacity of the ship 1, and its stability and propulsive quality in aqueous media 9.

A method, in accordance with the invention, for reconstructing an available ship having an existing hull and keel arrangement, to improve major navigability qualities by enhancing buoyancy and ensuring appropriate weight-carrying capacity without compromising safety, will include: (a) obtaining a ship with a floatable hull having boards with two exterior sides above the water, a bottom having two semi-bottoms with exterior sides below the water, and a keel extending downwardly from the intersection of the semi-bottom; (b) adapting the semi-bottoms such that the exterior sides thereof are positioned at an angle of 120 degrees relative to one another; (c) adapting the hull such that the exterior sides of the boards lie in the same plane as the exterior sides of the semi-bottoms; and (d) adapting one of the semi-bottoms and the height of the keel such that the height of the keel is comparable to less than the breadth of the semi-bottoms. One preferred method of reconstructing an available ship according to the invention will additionally comprise varying the breadth of the semi-bottoms and the height of the keel under a commensurable ratio.

In summary, according to the invention, maximum stability of a ship 1 is reached when the angles between the keel 6 and semi-bottoms 5 are equal to 120 degrees, the ratio of the keel 6 height "h" and the semi-bottom 5 breadth "b" is comparable and preserved in accordance with the relationship $h \leqq b$, and the exterior sides 4 of the boards 3 extend in the same outer plane as the semi-bottoms 5. This enables the waterline to safely rise up the hull 2 of the ship 1 under increasing load, automatically adding to the breadth of the semi-bottoms 5 to approaching the top of what was the exterior sides 4 of the boards 3 prior to such increasing load. Thus, the invention enlarges the weight-carrying capacity of the ship 1 under conditions of preserved stability.

While there is shown and described herein certain specific structure embodying the present invention, those skilled in the art will appreciate that alternate structure may be devised in accordance with the invention without departing from the spirit and scope of the underlying inventive concept as described herein and shown in the drawings, as indicated by the scope of appended claims.

What is claimed is:

1. A ship, comprising a floatable hull having, a first semi-bottom having a lower edge and an upper portion;

a second semi-bottom having a lower edge and an upper portion; wherein said first semi-bottom and said second semi-bottom each comprise an essentially planar outer surface; wherein the waterline of the ship extends around the hull between the lower edges and the upper portions of said first semi-bottom and said second semi-bottom and wherein said upper portions of said first semi-bottom and said second semi-bottom define hull edges proximate a deck; and a keel;

wherein said first semi-bottom is positioned at a first angle $\alpha_1$ of 120 degrees relative to said second semi-bottom;

wherein said first and second semi-bottoms, together, define a generally V-shaped relationship, wherein said keel extends downwardly from said semi-bottoms;

wherein said first and second semi-bottoms, together with said keel, define a generally Y-shaped relationship;

wherein said first semi-bottom is positioned at a second angle $\alpha_2$ of 120 degrees relative to said keel;

wherein said second semi-bottom is also positioned at a third angle $\alpha_3$ of 120 degrees relative to said keel;

wherein the height of said keel extending downwardly from said semi-bottoms is less than or equal to the breadth of either said semi-bottom as measured from said lower edges of said semi-bottom to the waterline; and wherein the breadths of each said semi-bottom is equal.

2. A ship, comprising, a first planar semi-bottom member;

a first planar hull member extending from said first planar semi-bottom member to the sheer line of the ship;

a second planar semi-bottom member;

a second planar hull member extending from said second planar semi-bottom member to said sheer line, wherein the waterline extends around the ship between said semi-bottom members and said planar hull members, wherein said first planar semi-bottom member and said first planar hull member are defined in a first plane, and wherein said second planar semi-bottom member and said second planar hull member are defined in a second plane, the intersection of said first and second planes defining the deadrise of a floatable hull of said ship; and a keel extending downwardly from said first and second planar semi-bottom members;

wherein the relative relationships between said first plane and said keel and between said second plane and said keel are equal to said deadrise, and wherein the height of said keel as measured downwardly from said planar semi-bottom members does not exceed the breadth of said planar semi-bottom members as measured from the keel to said waterline.

3. The ship of claim 2, wherein said deadrise is 120°.

4. The ship of claim 2, wherein a chine line, defined by an intersection of each said planar hull member with each said related planar semi-bottom member, is defined at a distance relative to said keel, wherein said distance is greater than or equal to the height of said keel.

5. The ship of claim 2, wherein a style line, defined by an offset in the plane of each said hull member, establishes a plane that is essentially flat.

6. A method of reconstructing a ship to improve major navigability qualities in water without compromising safety, comprising the steps of:

a) obtaining a ship comprising a floatable hull having boards including two exterior sides carried above the water, a bottom having two exterior semi-bottoms carried below the water, and a keel extending downwardly from the semi-bottoms;

b) adapting said bottom such that said exterior semi-bottoms are positioned at a 120° angle relative to one another;

c) adapting said hull such that said exterior sides lie in the same planes as said exterior semi-bottoms to the sheer line of the ship; and d) adapting at least one of said adapted bottom and said keel such that the breadth of said semi-bottoms is not less than the height of said keel.

7. The method of reconstructing a ship according to claim 6, the ship having an existing hull and keel arrangement, wherein the breadth of the semi-bottoms and the height of the keel are varied under proportionate ratio.

8. The ship of claim 1 wherein said hull edges establish the sheer line of the ship.

* * * * *